US010487613B2

(12) United States Patent
Murphy

(10) Patent No.: US 10,487,613 B2
(45) Date of Patent: Nov. 26, 2019

(54) RETRIEVABLE PRE-TENSION PACKING ASSEMBLY

(71) Applicant: HALLIBURTON ENERGY SERVICES, INC., Houston, TX (US)

(72) Inventor: Thomas Murphy, Westhill Aberdeenshire (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/542,593

(22) PCT Filed: Mar. 9, 2015

(86) PCT No.: PCT/US2015/019375
§ 371 (c)(1),
(2) Date: Jul. 10, 2017

(87) PCT Pub. No.: WO2016/144311
PCT Pub. Date: Sep. 15, 2016

(65) Prior Publication Data

US 2018/0266203 A1 Sep. 20, 2018

(51) Int. Cl.
*E21B 33/12* (2006.01)
*E21B 33/128* (2006.01)
*E21B 33/134* (2006.01)

(52) U.S. Cl.
CPC ..... *E21B 33/1208* (2013.01); *E21B 33/128* (2013.01); *E21B 33/134* (2013.01)

(58) Field of Classification Search
CPC .... E21B 33/12; E21B 33/128; E21B 33/1208; E21B 23/06; E21B 23/00
See application file for complete search history.

(56) References Cited

U.S. PATENT DOCUMENTS 2,222,846 A 11/1940 Johnston
6,142,227 A 11/2000 Hiorth et al.
(Continued)

FOREIGN PATENT DOCUMENTS

EP 0141726 A2 5/1985
WO WO 2012167240 A2 12/2012

OTHER PUBLICATIONS

International Search Report and Written Opinion for International Application No. PCT /US2015/019375 dated Oct. 19, 2015. (7 pages).

(Continued)

*Primary Examiner* — D. Andrews
*Assistant Examiner* — Manuel C Portocarrero
(74) *Attorney, Agent, or Firm* — Haynes and Boone, LLP

(57) ABSTRACT

A method includes providing a retrievable plug assembly at a surface of an oil or gas well, the plug assembly having a seal element that has an original outer diameter. The method also includes stretching the seal element so that the outer diameter is less than the original outer diameter and then placing the plug assembly between first and second zones formed within the tubing string. The method also includes removing any tensile axial load on the seal element so that it shrinks back towards its original outer diameter while positioned between the first and second zones. The method also includes compressing the seal element so that the seal element sealingly engages an inner surface of the tubing string to isolate the first zone from the second zone.

20 Claims, 6 Drawing Sheets

(56) References Cited

U.S. PATENT DOCUMENTS

| | | | | |
|---|---|---|---|---|
| 6,182,755 | B1 | 2/2001 | Mansure | |
| 6,343,791 | B1 | 2/2002 | Anyan et al. | |
| 6,812,755 | B2 | 11/2004 | Yee et al. | |
| 2004/0256115 | A1 | 12/2004 | Vincent et al. | |
| 2005/0067170 | A1 | 3/2005 | Richard | |
| 2010/0051259 | A1 | 3/2010 | Pessin et al. | |
| 2010/0307773 | A1* | 12/2010 | Tinnen | E21B 23/06 166/387 |
| 2011/0147015 | A1 | 6/2011 | Mickey et al. | |
| 2012/0175845 | A1 | 7/2012 | Duan et al. | |
| 2013/0256991 | A1* | 10/2013 | Ramon | E21B 33/12 277/316 |
| 2013/0306327 | A1 | 11/2013 | Williamson | |
| 2014/0284046 | A1 | 9/2014 | Bramwell | |

OTHER PUBLICATIONS

Examination report issued by the Australian Patent Office for Australian Patent Application No. 2015385847 dated Jun. 7, 2018. (8 pages).

English Translation of Preliminary French Search Report issued by INPI for French Patent Application No. 1650358. (10 pages).

Examiner's Letter issued by the Canadian Intellectual Property Office for Canadian Patent Application No. 2976097 dated Jul. 30, 2018. (4 pages).

* cited by examiner

RETRIEVABLE PRE-TENSION PACKING ASSEMBLY

TECHNICAL FIELD

The present disclosure relates generally to a packer assembly used in wells, and specifically, to a retrievable pre-tension packing assembly for mid-expansion applications.

BACKGROUND

After a well is drilled and a target reservoir has been encountered, completion and production operations are performed, which may include running a tubing string downhole within the wellbore. Often, a first zone of the tubing string is isolated from a second zone of the tubing string. In order to isolate the first zone from the second zone, a packing assembly, such as a bridge plug that includes a seal element is extended into the tubing string. The bridge plug is "set" moved into an expanded state such that the seal element sealingly engages an inner surface of the tubing string to isolate the first zone from the second zone.

Often, a seal element is run downhole in a neutral configuration (i.e., undergoing no axial tensile or compression loading) and then expands to contact the inner surface of the tubing string, which often results in a high amount of stress and strain on the seal element. This may result in poor sealing performance and retrievability issues.

The present disclosure is directed to a retrievable pre-tension packing assembly for mid-expansion applications that addresses one or more of the foregoing issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
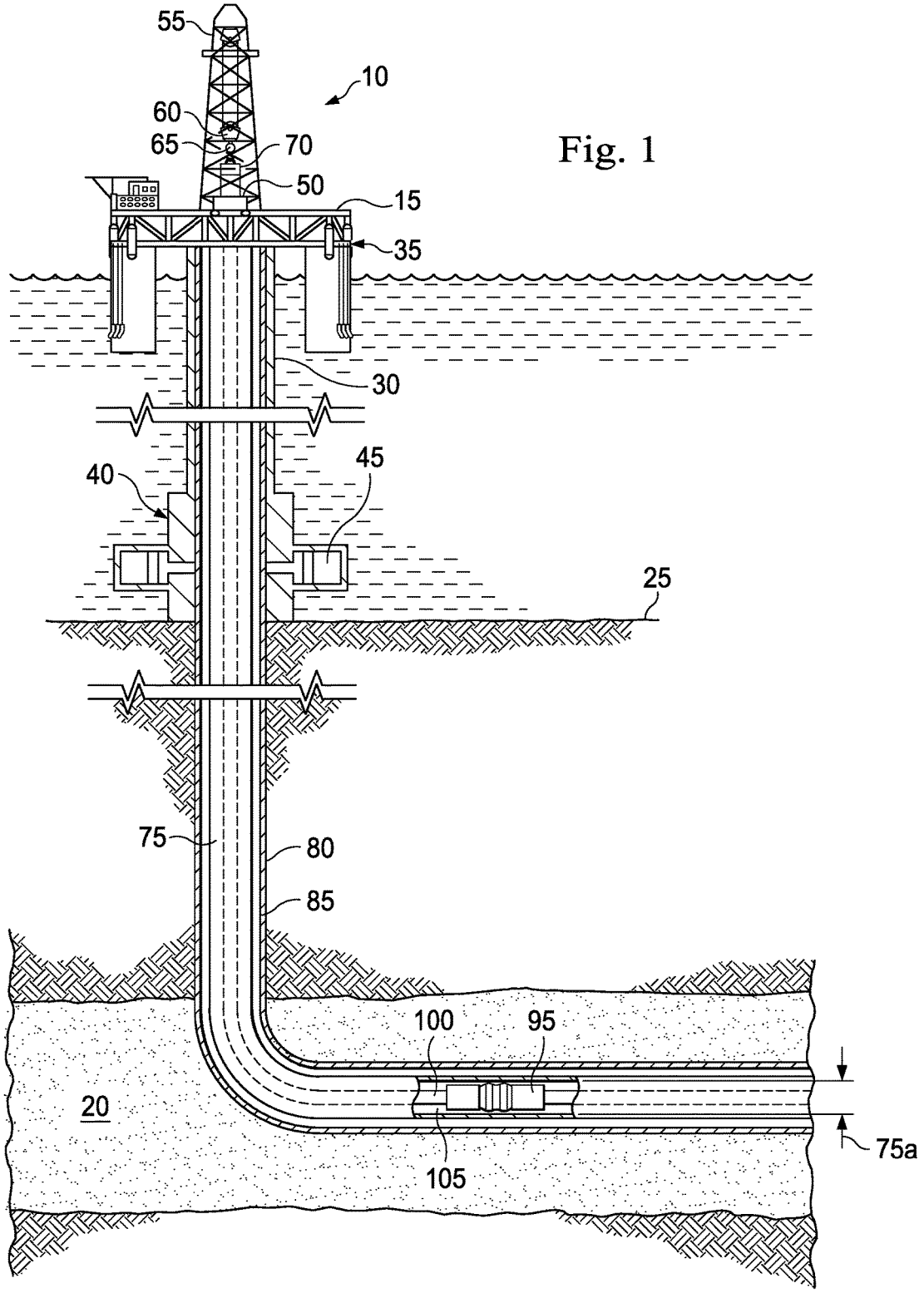
FIG. 1 is a schematic illustration of an offshore oil and gas platform operably coupled to a packing assembly, according to an exemplary embodiment of the present disclosure.

Illustrative embodiments and related methods of the present disclosure are described below as they might be employed in a retrievable pre-tension packing assembly and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Referring initially to FIG. 1, a well having a retrievable pre-tension packing assembly is disposed therein from an offshore oil or gas platform that is schematically illustrated and generally designated 10. A semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. In one or more exemplary embodiments, the platform 15 may have a hoisting apparatus 50, a derrick 55, a travel block 60, a hook 65, and a swivel 70 for raising and lowering pipe strings, such as a substantially tubular, axially extending tubing string 75. In one or more exemplary embodiments, a wellbore 80 extends through the various earth strata including the formation 20 and has a casing string 85 cemented therein. In one or more exemplary embodiments, disposed in a substantially horizontal portion of the wellbore 80 is at least one retrievable pre-tension packing assembly, or bridge plug assembly 95, disposed on an inner mandrel 100 that extends within a passage 105 formed within the tubing string 75. In one or more exemplary embodiments, the tubing string 75 has an inner diameter of 75*a*.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
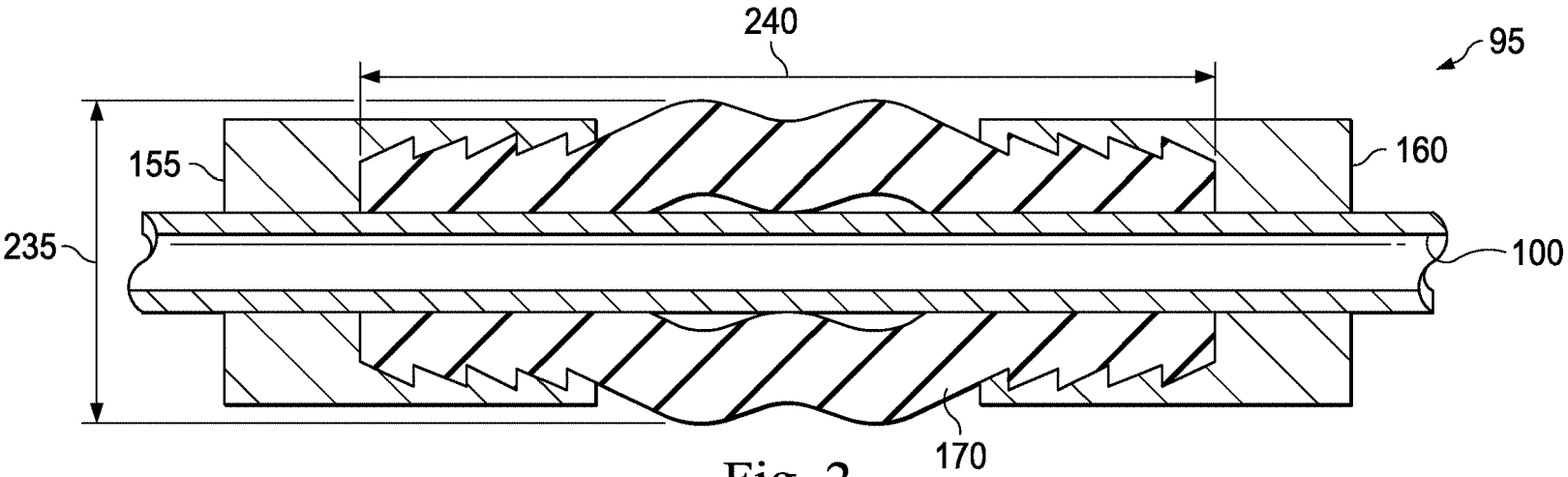
FIG. 2 illustrates a sectional view of a portion of the packing assembly of FIG. 1 in a first configuration, according to an exemplary embodiment of the present disclosure.

In one or more exemplary embodiments, and as illustrated in FIG. 2, the bridge plug assembly 95 includes gauge rings 155 and 160 that are concentrically disposed and axially spaced about the mandrel 100. In one or more exemplary embodiments, a seal element or a packing element 170 is concentrically disposed about the mandrel 100 and accommodated between the gauge rings 155 and 160. In one or more exemplary embodiments, at least a portion of the gauge rings 155 and 160 are concentrically disposed about an exterior surface of the packing element 170 such that the gauge rings 155 and 160 are coupled to the packing element 170. In one or more exemplary embodiments, the packing element 170 includes an elastomer. In one or more exemplary embodiments, the packing element 170 defines a cross-section and the packing element 170 extends uninterruptedly throughout the cross-section. In an exemplary embodiment, the bridge plug assembly 95 also includes a backup assembly (not shown). In one or more exemplary embodiments, each of the gauge rings 155 and 160 has an interior surface that forms teeth that correspond with teeth formed on the exterior surface of the packing element 170. However, the gauge rings 155 and 160 may be coupled to the packing element in a variety of ways.

Figure 3:
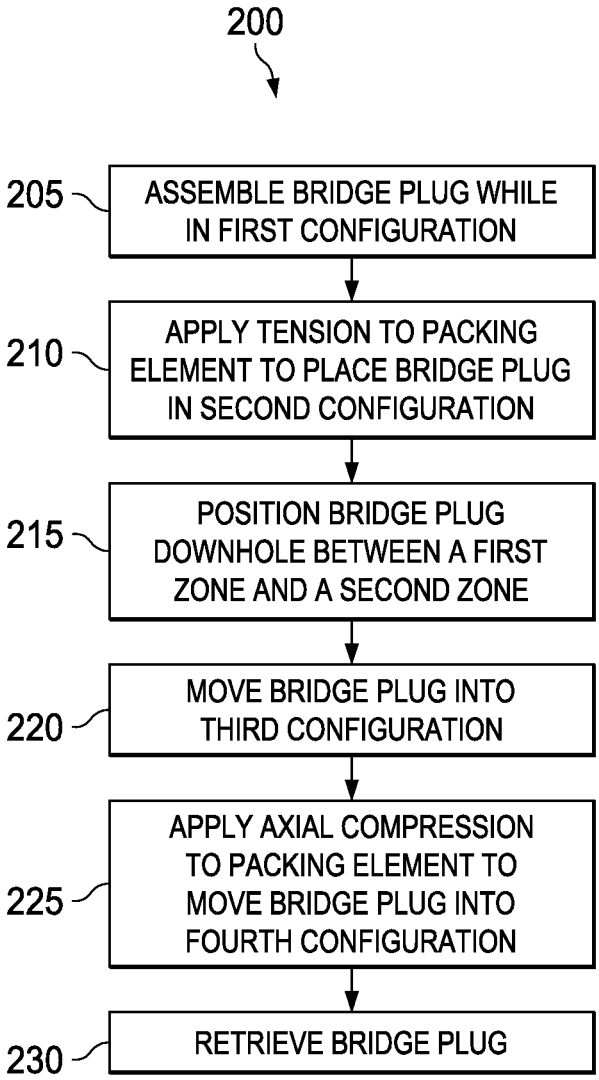
FIG. 3 is a flow chart illustration of a method of operating the packing assembly of FIG. 1, according to an exemplary embodiment of the present disclosure.

With reference to FIG. 3 and with continuing reference to FIGS. 1-2, in one or more embodiments, a method of operating the bridge plug 95 is generally referred to by the reference numeral 200 and may include assembling the bridge plug 95 while in a first configuration at step 205; applying tension to the packing element 170 to place the bridge plug 95 in a second configuration at step 210; positioning the bridge plug 95 downhole between a first zone and a second zone at step 215; allowing the bridge plug 95 to return to a third configuration at step 220; applying axial compression to the packing element 170 to place the bridge plug 95 in a fourth configuration thereby isolating the first zone from the second zone at step 225; and removing the bridge plug 95 from between the first zone and the second zone at step 230. In one or more exemplary embodiments, the packing element 170 has a first configuration, a second configuration, a third configuration, and a fourth configuration that corresponds with the first configuration, the second configuration, the third configuration, and the fourth configuration of the plug assembly 95.

At the step 205, the bridge plug 95 is assembled or manufactured while in the first configuration. As illustrated in FIG. 2, while the bridge plug 95 is in the first configuration, the packing element 170 has a first outer diameter 235 and a first length 240. In one or more exemplary embodiments, the first outer diameter 235 is an original outer diameter. In one or more exemplary embodiments, the gauge rings 155 and 160 are axially spaced such that the packing element 170 is not stretched or compressed. Thus, the first configuration is a neutral configuration (i.e., a configuration in which the packing element 170 undergoes no axial tension or axial compression). In one or more exemplary embodiments, the first outer diameter 235 is greater than the inner diameter 75*a* of the tubing string 75. Thus, the packing element 170 has an outer diameter larger than the inner diameter of the tubing string while the bridge plug 95 is in the first configuration. However, in one or more exemplary embodiments, the first outer diameter 235 is equal to or less than the inner diameter 75*a* of the tubing string.

Figure 4:
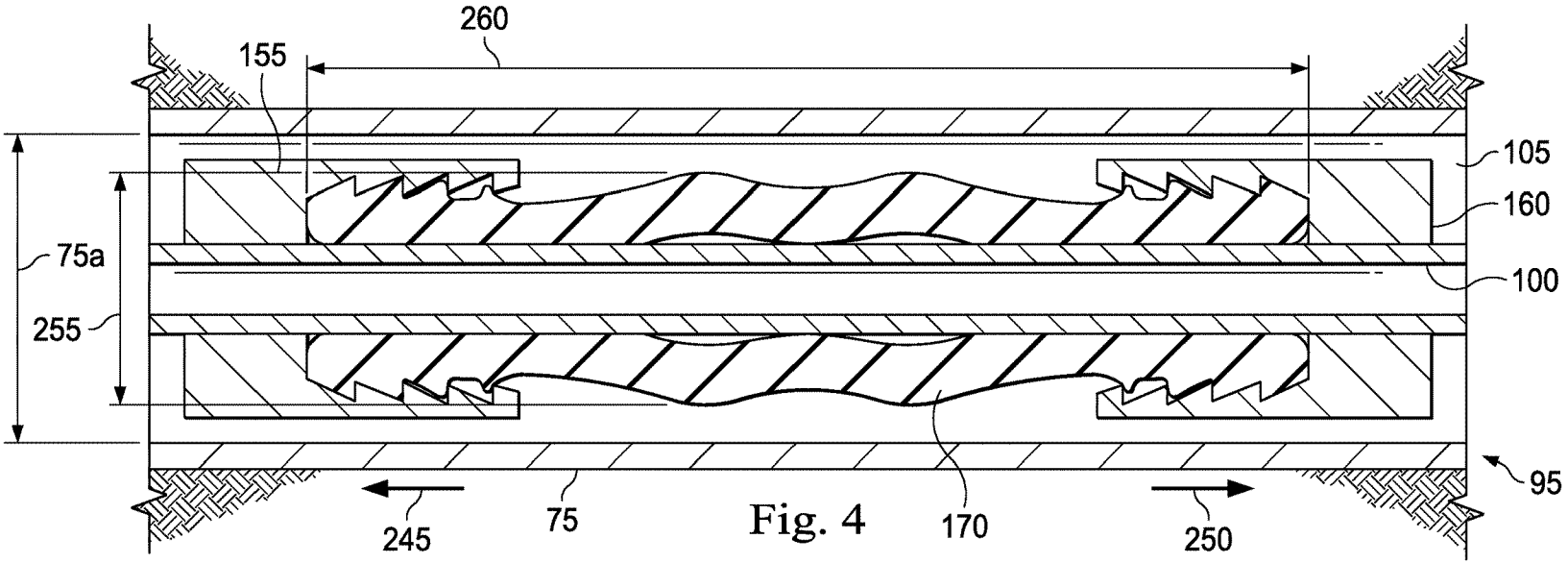
FIG. 4 illustrates a sectional view of a portion of the packing assembly of FIG. 1 in a second configuration, according to an exemplary embodiment of the present disclosure.

At the step 210, tension is applied to the packing element 170 to move the bridge plug 95 into the second configuration, as illustrated in FIG. 4. In one or more exemplary embodiments, the bridge plug 95 is in the second configuration prior to deploying the bridge plug 95 downhole, or placing it in the passage 105 formed by the tubing string 75. In one or more exemplary embodiments, the ring gauge 166 and 160 are axially spaced such that the packing element 170 is under tension and stretched in the axial direction. In one or more exemplary embodiments, the ring gauge 155 applies a tensile axial load on the packing element 170 by pulling a portion of the packing element 170 in a direction indicated by numeral 245 in FIGS. 4-6 and the ring gauge 160 applies a tensile axial load on the packing element 170 by pulling a portion of the packing element in a direction indicated by numeral 250 in FIGS. 4-6. In one or more exemplary embodiments and when the bridge plug 95 is in the second configuration, the packing element 170 has a second outer diameter 255 and a second length 260. As the packing element 170 is stretched in the axial direction, the second outer diameter 255 is less than the first outer diameter 235. In one or more exemplary embodiments, the second outer diameter 255 is less than the inner diameter 75*a* of the tubing string 75. In one or more exemplary embodiments, the second outer diameter 255 is less than an outer diameter of the ring gauge 155 or an outer diameter of the ring gauge 160 or both. Thus, the bridge plug 95 may be extended and moved within the tubing string 75 while the bridge plug 95 is in the second configuration, as the packing element 170 is spaced from an inner surface of the tubing string 75 when extended within the tubing string 75. In one or more exemplary embodiments, the packing element 170 is under a tensile axial load while the bridge plug 95 is in the second configuration to reduce the outer diameter of the packing element 170. In one or more exemplary embodiments, packing element 170 is stretched while the bridge plug 95 is in the second configuration such that the second length 260 is greater than the first length 240.

At the step 215, the bridge plug 95 is positioned downhole between a first zone of passage 105 and a second zone of the passage 105. In one or more exemplary embodiments, the bridge plug 95 is in the second configuration when positioned downhole between the first zone and the second zone. In an exemplary embodiment and when the bridge plug 95 is extended within the tubing string 75 while in the second configuration, the packing element 170 is spaced from the inner surface of the tubing string 75.

Figure 5:
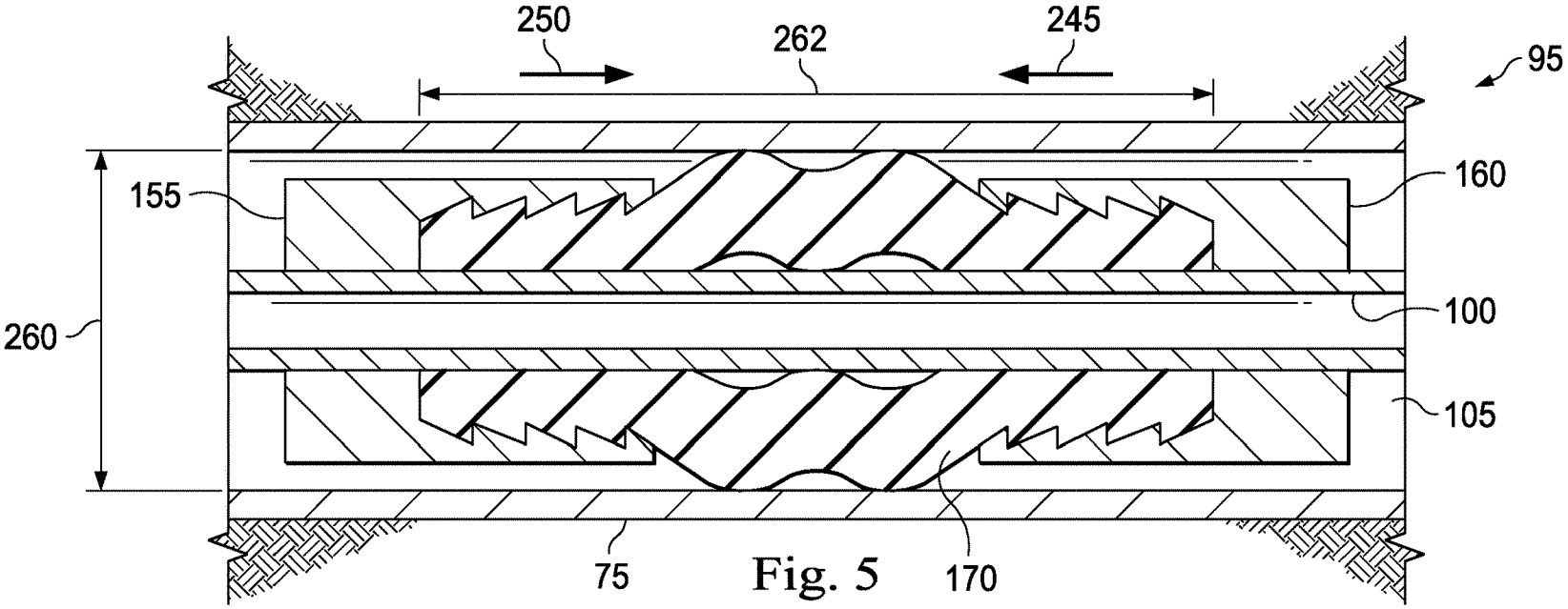
FIG. 5 illustrates a sectional view of a portion of the packing assembly of FIG. 1 in a third configuration, according to an exemplary embodiment of the present disclosure.

At the step 220, the bridge plug 95 is moved into the third configuration, as illustrated in FIG. 5. In one or more exemplary embodiments, the bridge plug 95 is allowed to "relax" to the third configuration. That is, the tensile axial load is removed from the packing element 170 so that the packing element 170 is in the neutral configuration. In one or more exemplary embodiments, the tensile axial load on the packing element 170 is eliminated or reduced such that the packing element 170 and the bridge plug 95 moves towards the first configuration. Thus, in one or more exemplary embodiments, the packing element 170 expands radially to a third outer diameter 260 and the length shrinks to a third length 262. In one or more exemplary embodiments, the third length 262 is less than the second length 260. As the first outer diameter 235 of the packing element 170 while the bridge plug 95 is in the first configuration is greater than the inner diameter 75*a* of the tubing string 75, the third outer diameter 260 may equal to the inner diameter 75*a* while the bridge plug 95, and the packing element 170, are in the third configuration. That is, the inner surface of the tubing string 75 limits the radial expansion of the packing element 170. However, in one or more other exemplary embodiments, the outer diameter 260 may be less than the inner diameter 75*a*. Nevertheless, the third outer diameter 260 of the packing element 170 while the bridge plug 95 is in the third configuration is greater than the second outer diameter 255 of the packing element 170 while the bridge plug 95 is in the second configuration. In one or more exemplary embodiments, the packing element 170 has the third outer diameter 260 without undergoing any axial compression. This allows for the packing element 170 to be at least partially set without undergoing stress relating to compression. In one or more exemplary embodiments, the tensile axial load may be removed from the packing element 170 by adjusting the axially spacing of the gauge rings 155 and 160.

Figure 6:
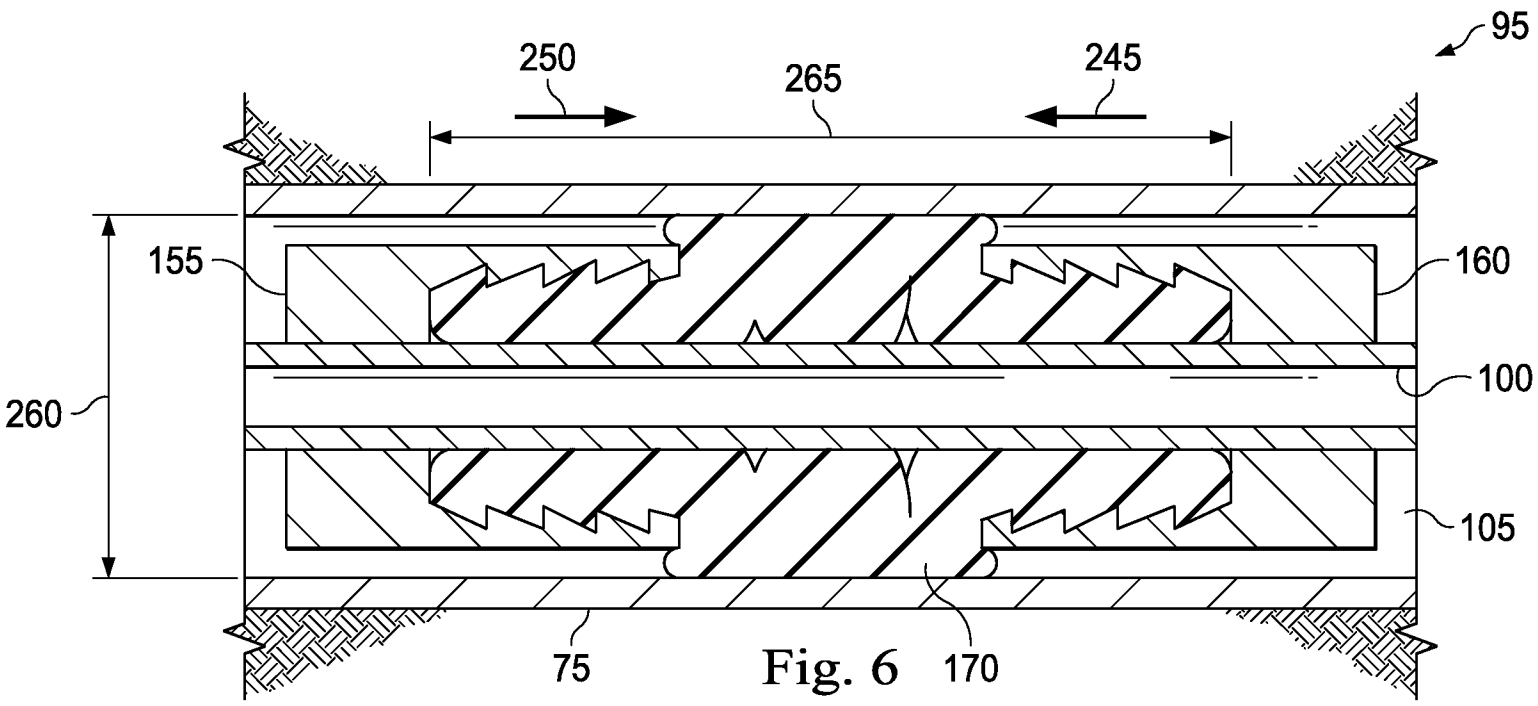
FIG. 6 illustrates a sectional view of a portion of the packing assembly of FIG. 1 in a fourth configuration, according to an exemplary embodiment of the present disclosure.

At the step 225, axial compression is applied to the packing element 170 to move the bridge plug 95 into the fourth configuration, as illustrated in FIG. 6. In one or more exemplary embodiments, the gauge ring 155 moves in the direction 250 illustrated in FIGS. 4-6 and the gauge ring 160 moves in the direction 245 illustrated in FIGS. 4-6 to compress the packing element 170 (i.e., axial compression). In one or more exemplary embodiments, the packing element 170 and bridge plug 95 is considered "set" while in the fourth configuration, as the axial compression of the packing element 170 results in a portion, or a larger portion, of the exterior surface of the packing element 170 contacting the inner surface of the tubing string 75. In one or more exemplary embodiments, the exterior surface of the packing element 170 sealingly engages the inner surface of the tubing string 75 to fluidically isolate the first zone of the passage 105 from the second zone of the passage 105. In one or more exemplary embodiments and when the third outer diameter 260 is this equal to the inner diameter 75*a* of the tubing 75, the packing element 170 deforms while the bridge plug 95 is in the fourth configuration such that a larger portion of the exterior surface of the packing element 170 has the third outer diameter 260. In other exemplary embodiments and when the third outer diameter 260 is less than the inner diameter 75*a* of the tubing string 75, then the packing element 170 deforms while the bridge plug 95 is in the fourth configuration to have a fourth outer diameter that is equal to the inner diameter 75*a* of the tubing string 75. In one or more exemplary embodiments, the packing element 170 has a fourth length 265 that is less than the third length 262, the second length 260, and the first length 240. In one or more exemplary embodiments, the amount of axial compression to move the bridge plug 95 from the third configuration to the fourth configuration results in significantly less stress in the packing element 170 while the bridge plug 95 is in the fourth configuration because the packing element 170, while in the neutral configuration, is already partially set when the bridge plug 95 is in the third configuration.

At the step 230, the bridge plug 95 is retrieved from downhole. In one or more exemplary embodiments, axial compression is removed from the packing element 170 by axially adjusting the gauge rings 155 and 160 and the bridge plug 95 is removed from the wellbore. In one or more exemplary embodiments, the steps 225, 220, 215, 210 may be performed in reverse to retrieve the bridge plug 95 from downhole.

In one or more exemplary embodiments, the bridge plug 95 is a medium expansion plug. In one or more exemplary embodiments, the bridge plug 95 is a medium expansion plug and is adapted to be exposed to high downhole pressures.

In one or more exemplary embodiments, the bridge plug 95 is a pre-tension mid-expansion plug that is retrievable. In one or more exemplary embodiments, the bridge plug 95 expands radially in response to an axial compression force. In one or more exemplary embodiments, the bridge plug 95 is partially set when in the third configuration. In one or more exemplary embodiments, the packing element 170 is under little or no compression forces when in the third configuration. Thus, the packing element 170 is under little or no stress when in the third configuration. Considering the packing element 170 is under no little or no stress when partially set, the stress created within the bridge plug 95 and/or the packing element 170 when transitioning to the fourth configuration is low. Thus, low stresses when in the fully set configuration, or the fourth configuration, results in enhanced sealing performance of the packing element 170 and easy retrieval of the bridge plug 95 from the wellbore.

In one or more exemplary embodiments, an axial force and axial movement is generally perpendicular to a radial force and radial movement.

In one or more exemplary embodiments, the packing element 170, the gauge rings 155 and 160, and the method 200 may be applied to any variety of downhole tools, such as bridge through plugs, packers, etc.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a packing element has been described. Embodiments of the packing assembly may generally include a packing assembly adapted to extend within a pre-existing structure, the pre-existing structure defining a circumferentially extending inner surface defining an inner diameter, the packing assembly includes an elongated base pipe and a seal element disposed on the base pipe. For any of the foregoing embodiments, packing assembly may include any one of the following elements, alone or in combination with each other:

- The packing assembly is radially shrinkable from a first configuration to a second configuration and radially expandable from the second configuration to a third configuration.
- When the packing assembly in the first configuration, the seal element has a first diameter that is greater than the inner diameter.

When the packing assembly in the second configuration, the seal element has a second diameter that is less than the first diameter and less than the inner diameter.

The second outer diameter is less than an outer diameter of at least one of the first and second gauge rings.

When the packing assembly is in the third configuration, the seal element has a third diameter that is greater than the second configuration and equal to or less than the inner diameter.

The packing assembly is a plug assembly.

The pre-existing structure is a tubing string.

The packing assembly further includes axially-spaced first and second gauge rings, each of the first and second gauges ring being disposed on the base pipe and coupled to the seal element.

When the packing assembly extends within the tubing string and the packing assembly is in the second configuration, the first and second gauge rings are spaced axially such that the seal element is under a tensile axial load.

When the packing assembly extends within the tubing string and the packing assembly is in the third configuration, the seal element is in a neutral configuration and the third diameter is equal to or less than the inner diameter.

When the packing assembly extends within the tubing string and the packing assembly is in a fourth configuration, the first and second gauge rings are spaced axially such that the seal element is under axial compression and the seal element sealingly engages the inner surface.

When the packing assembly is in the first configuration, the seal element is in a neutral configuration.

The packing assembly is in the first configuration at a surface of a well.

The packing assembly is in the second configuration at a surface of the well.

The packing assembly is a retrievable packing assembly.

The seal element is comprised of one or more elastomer materials.

The seal element defines a cross-section.

The one or more elastomer materials extends uninterruptedly throughout the cross-section.

When the packing assembly extends within the tubing string and the packing assembly is in the fourth configuration, the elastomer sealing engages the inner surface of the tubing string.

Thus, a method has been described. Embodiments of the method may generally include providing a plug assembly in a first configuration at a surface of a well in which a tubing string extends, the plug assembly including: an elongated base pipe adapted to extend within the tubing string; and a seal element disposed on the base pipe and defining a first outer diameter while in the first configuration; applying a tensile axial force to the seal element to move the plug assembly to a second configuration, the seal element defining a second outer diameter while in the second configuration; disposing the plug assembly in the tubing string; positioning the plug assembly while in the second configuration between a first zone and a second zone of a passage defined by the tubing string; removing the tensile axial force while the plug assembly is positioned between the first zone and the second zone such that the plug assembly moves to a third configuration, the seal element defining a third outer diameter while in the third configuration; and compressing the seal element while the plug assembly is in the third configuration to move the plug assembly to a fourth configuration such that the seal element is expanded in a radially outward direction to sealingly engage an inner surface of the tubing string. For any of the foregoing embodiments, the method may include any one of the following, alone or in combination with each other:

While the plug assembly is in the fourth configuration, the seal element fluidically isolates the first zone of the passage from the second zone of the passage.

The first configuration and the third configuration are associated with the seal element being in a neutral configuration.

The plug assembly further includes first and second gauge rings, each of the first and second gauge rings being disposed on the base pipe and coupled to the seal element, the seal element being disposed between the first and second gauge rings.

The seal element has a first length while the plug assembly is in the first configuration.

Applying the tensile axial force to the seal element axially stretches the seal element such that the seal element has a second length while the plug assembly is in the second configuration, the second length being greater than the first length.

Removing the tensile axial force while the plug assembly is positioned between the first zone and the second zone causes the seal element to have a third length while the plug assembly is in the third configuration, the third length being less than the second length.

Compressing the seal element while the plug assembly is in the third configuration to move the plug assembly to the fourth configuration causes the seal element to have a fourth length while the plug assembly is in the fourth configuration, the fourth length being less than the second length and less than the first length.

The inner surface of the tubing string defines an inner diameter.

The first outer diameter is greater than the inner diameter.

The second outer diameter is less than the inner diameter.

The second outer diameter is less than an outer diameter of at least one of the first and second gauge rings.

The fourth outer diameter is equal to the inner diameter.

Retrieving the plug assembly from within the well.

The seal element is comprised of one or more elastomer materials.

The seal element defines a cross-section.

The one or more elastomer materials extends uninterruptedly throughout the cross section.

The plug assembly is a retrievable plug assembly.

Compressing the seal element while the plug assembly is in the third configuration to move the plug assembly to the fourth configuration causes the elastomer to sealing engage the inner surface of the tubing string.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A packing assembly adapted to extend within a pre-existing structure, the pre-existing structure defining a circumferentially extending inner surface defining an inner diameter, the packing assembly comprising:

an elongated base pipe; and a seal element disposed on the base pipe; wherein teeth are formed on an exterior surface of the seal element; and axially-spaced first and second gauge rings disposed on the base pipe and coupled to the seal element;

wherein the first gauge ring has a first axial length defined by a first end and an opposing second end;

wherein the first end is concentrically disposed about the seal element;

wherein the first gauge ring has an interior surface extending from the first end and toward the second end;

wherein the interior surface of the first gauge ring forms teeth that point toward the second end and that engage the teeth formed on the exterior surface of the seal element;

wherein the second gauge ring has a second axial length defined by a third end and an opposing fourth end;

wherein the third end is concentrically disposed about the seal element;

wherein the second gauge ring has an interior surface extending from the third end and toward the fourth end;

wherein the interior surface of the second gauge ring forms teeth that point toward the fourth end and that engage the teeth formed on the exterior surface of the seal element;

wherein the packing assembly is radially shrinkable from a first configuration to a second configuration and radially expandable from the second configuration to a third configuration;

wherein, when the packing assembly is in the first configuration, the seal element has a first diameter;

wherein, when the packing assembly is in the second configuration, the seal element has a second diameter that is less than the first diameter and less than the inner diameter; and wherein, when the packing assembly is in the third configuration, the seal element has a third diameter that is greater than the second diameter and equal to or less than the inner diameter.

2. The packing assembly of claim 1, wherein the packing assembly is a plug assembly;

wherein the pre-existing structure is a tubing string;

wherein, when the packing assembly extends within the tubing string and when the packing assembly is in the second configuration, the first and second gauge rings are spaced axially such that the seal element is under a tensile axial load; and wherein the second outer diameter is less than an outer diameter of at least one of the first and second gauge rings.

3. The packing assembly of claim 2, wherein, when the base pipe extends within the tubing string and the packing assembly is in the third configuration, the seal element is in a neutral configuration and the third diameter is equal to or less than the inner diameter.

4. The packing assembly of claim 2, wherein, when the packing assembly extends within the tubing string and the packing assembly is in a fourth configuration, the first and second gauge rings are spaced axially such that the seal element is under axial compression and the seal element sealingly engages the inner surface; and wherein, when the packing assembly is in the fourth configuration, a portion of the seal element overlaps the first end and the third end such that the seal element extends between the inner surface and each of the first and third ends.

5. The packing assembly of claim 2, wherein, when the packing assembly is in the first configuration, the first diameter of the seal element is greater than the inner diameter; and wherein, when the packing assembly is in the first configuration, the seal element is in a neutral configuration.

6. The packing assembly of claim 2, wherein the packing assembly is in the first configuration at a surface of a well in which the tubing string extends.

7. The packing assembly of claim 2, wherein the packing assembly is in the second configuration at a surface of the well in which the tubing string extends.

8. The packing assembly of claim 2, wherein the seal element is comprised of one or more elastomer materials; and wherein, when the packing assembly extends within the tubing string and the packing assembly is in the fourth configuration, the elastomer sealing engages the inner surface of the tubing string.

9. The packing assembly of claim 1, wherein the packing assembly is a retrievable packing assembly.

10. The packing assembly of claim 1, wherein the seal element is comprised of one or more elastomer materials;

wherein the seal element defines a cross-section; and wherein the one or more elastomer materials extends uninterruptedly throughout the cross-section.

11. A method comprising:

providing a plug assembly in a first configuration at a surface of a well in which a tubing string extends, the plug assembly comprising:

an elongated base pipe adapted to extend within the tubing string; and a seal element disposed on the base pipe and defining a first outer diameter while in the first configuration; wherein teeth are formed on an exterior surface of the seal element; and axially-spaced first and second gauge rings disposed on the base pipe and coupled to the seal element;

wherein the first gauge ring has a first axial length defined by a first end and an opposing second end;

wherein the first end is concentrically disposed about the seal element;

wherein the first gauge ring has an interior surface extending from the first end and toward the second end;

wherein the interior surface of the first gauge ring forms teeth that point toward the second end and that engage the teeth formed on the exterior surface of the seal element;

wherein the second gauge ring has a second axial length defined by a third end and an opposing fourth end;

wherein the third end is concentrically disposed about the seal element;

wherein the second gauge ring has an interior surface extending from the third end and toward the fourth end; and wherein the interior surface of the second gauge ring forms teeth that point toward the fourth end and that engage the teeth formed on the exterior surface of the seal element;

applying a tensile axial force to the seal element to move the plug assembly to a second configuration, the seal element defining a second outer diameter while the plug assembly is in the second configuration;

disposing the plug assembly in the tubing string;

positioning the plug assembly while in the second configuration between a first zone and a second zone of a passage defined by the tubing string;

removing the tensile axial force while the plug assembly is positioned between the first zone and the second zone such that the plug assembly moves to a third configuration, the seal element defining a third outer diameter while in the third configuration; and compressing the seal element while the plug assembly is in the third configuration to move the plug assembly to a fourth configuration such that the seal element is expanded in a radially outward direction to sealingly engage an inner surface of the tubing string;

wherein while the plug assembly is in the fourth configuration, the seal element fluidically isolates the first zone of the passage from the second zone of the passage.

12. The method of claim 11, wherein the first configuration and the third configuration are associated with the seal element being in a neutral configuration.

13. The method of claim 11, wherein the seal element has a first length while the plug assembly is in the first configuration;

wherein applying the tensile axial force to the seal element axially stretches the seal element such that the seal element has a second length while the plug assembly is in the second configuration, the second length being greater than the first length; and wherein the second outer diameter is less than an outer diameter of at least one of the first and second gauge rings.

14. The method of claim 13, wherein removing the tensile axial force while the plug assembly is positioned between the first zone and the second zone causes the seal element to have a third length while the plug assembly is in the third configuration, the third length being less than the second length.

15. The method of claim 14, wherein compressing the seal element while the plug assembly is in the third configuration to move the plug assembly to the fourth configuration causes the seal element to have a fourth length while the plug assembly is in the fourth configuration, the fourth length being less than the second length and less than the first length; and wherein, when the plug assembly is in the fourth configuration, a portion of the seal element overlaps the first end and the third end such that the seal element extends between the inner surface and each of the first and third ends.

16. The method of claim 13, wherein the inner surface of the tubing string defines an inner diameter;

wherein the first outer diameter is greater than the inner diameter;

wherein the second outer diameter is less than the inner diameter and is less than an outer diameter of at least one of the first and second gauge rings; and wherein the fourth outer diameter is equal to the inner diameter.

17. The method of claim 11, further comprising retrieving the plug assembly from within the well.

18. The method of claim 11, wherein the seal element is comprised of one or more elastomer materials;

wherein the seal element defines a cross-section; and wherein the one or more elastomer materials extends uninterruptedly throughout the cross section.

19. The method of claim 11, wherein the plug assembly is a retrievable plug assembly.

20. The method of claim 11, wherein the seal element is comprised of one or more elastomer materials; and wherein compressing the seal element while the plug assembly is in the third configuration to move the plug assembly to the fourth configuration causes the elastomer to sealing engage the inner surface of the tubing string.

* * * * *